US005730348A

United States Patent [19]

Tien

[11] Patent Number: 5,730,348

[45] Date of Patent: Mar. 24, 1998

[54] FASTENING FOR SECURING AN APPARATUS TO A BELT

[76] Inventor: Tse-Hsiung Tien, 12th Fl., No. 561, Mingshui Rd., Taipei, Taiwan

[21] Appl. No.: 827,804

[22] Filed: Apr. 11, 1997

[51] Int. Cl.[6] ..... A45F 5/00

[52] U.S. Cl. ..... 224/669; 224/271; 224/272; 224/930; 24/3.12; 24/182; 24/528

[58] Field of Search ..... 224/197, 198, 224/199, 665, 672, 269, 271, 272, 930; 24/3.1, 3.12, 182, 528

[56] References Cited

U.S. PATENT DOCUMENTS

| | | | |
|---|---|---|---|
| 688,047 | 12/1901 | Wilson | 24/168 |
| 2,823,434 | 2/1958 | Van Buren, Jr. | 24/3.1 |
| 2,917,213 | 12/1959 | Bucheimer et al. | 224/911 |
| 3,589,574 | 6/1971 | Marburger | 224/672 |
| 4,111,343 | 9/1978 | Selinko | 224/670 |
| 5,235,728 | 8/1993 | Nordberg | 224/670 |
| 5,452,497 | 9/1995 | Peng | 224/667 |

*Primary Examiner*—Henry J. Recla
*Assistant Examiner*—Gregory M. Vidovich
*Attorney, Agent, or Firm*—Kirkpatrick & Lockhart LLP

[57] ABSTRACT

A fastening for securing an apparatus, such as a pager or a mobile telephone, to a belt is disclosed. The fastening includes a body, a board and a flexure strip attached to the apparatus. The body defines a recess in a front portion thereof for receiving the flexure strip and has a plurality of ratchet teeth uniformly distributed at two opposed sides of a rear portion thereof. The board is movably received in the rear portion of the body and has pawls integrally formed thereon for engaging with respective pair of the ratchet teeth. The pawls has a press bar integrally formed therebetween and a hook is integrally formed at a rear end of the board for abutting the belt. By this arrangement, a space is defined between the board and the back of the apparatus, which can be adjusted and adapted for receiving different belts with various widths. Also, the direction of each ratchet tooth is configured to enable the board to move only toward the front portion of the body so that the belt can be securely gripped.

5 Claims, 5 Drawing Sheets

FASTENING FOR SECURING AN APPARATUS TO A BELT

BACKGROUND OF THE INVENTION

1. Field of the Invention

The present invention relates to a fastening, and more particularly to a fastening which is configured to secure an apparatus, such as a radio-pager, an intercom or a mobile telephone, to different belts with various width.

2. Description of Related Art

With the rapid development of communication technology, intercoms, radio-pagers, and mobile telephones have become popular. However, to use these communication apparatuses, it is necessary for a user to carry them everywhere. A conventional fastening for securing an apparatus 90 to a belt of a user is shown in FIG. 5. The fastening includes a body 1 with a hook-like piece 13 at a bottom end thereof. A pedestal 12 is disposed to connect the body 1 to a back of the apparatus 90. A shaft 14 extends through the pedestal 12 and a torsional spring 11 disposed on the pedestal 12 so that the body 1 can pivot about the shaft 14 to allow the belt to be disposed between a space (not numbered) defined by the apparatus 90 and the body 1. This fastening has a disadvantage that it is difficult to mount the torsional spring 11 due to its short tension arm. A second disadvantage is that the above mentioned space is fixed so that it is not adapted to receive different belts with various widths, as shown in FIG. 7 and FIG. 8. Another conventional fastening for securing an apparatus 90 to a belt of a user is shown in FIG. 6. This fastening includes a body 2 with a catch 23 at a bottom end thereof. A U-shaped flexure strip 21 is disposed to connect the body 2 to a back of the apparatus 90. The body 2 defines a cavity 22 to receive one side of the U-shaped flexure strip 21. Though this fastening solves the problem of difficult assembly of the torsion spring, it still has the disadvantage that the space defined between the apparatus 90 and the body 2 is fixed so that it is not adapted to receive different belts with various widths.

The present invention provides an improved fastening for securing an apparatus to a belt to mitigate and/or obviate the aforementioned problems.

SUMMARY OF THE INVENTION

One object of the present invention is to provide a fastening which is adapted for securing an apparatus, such as a radio-pager or a mobile telephone, to different belts with various widths.

Another object of the present invention is to provide a fastening which can be easily operated to secure an apparatus to a belt.

In accordance with one aspect of the present invention, a fastening for securing an apparatus to a belt comprises a flexure strip, a body and a board. The flexure strip is attached to the apparatus. The body defines a recess in a front portion thereof for receiving the flexure strip, a pair of channels at two opposed sides of a rear portion thereof, and an aperture in the rear portion. The body further has a plurality of ratchet teeth uniformly distributed at two opposed sides of a periphery defining the aperture. The board is movably received in the pair of channels of the body and has pawls integrally formed at a front end thereof for mating with a corresponding pair of the ratchet teeth, a press bar integrally formed between the pawls and a hook integrally formed at a rear end thereof for abutting a lower edge of the belt.

In accordance with another aspect of the present invention, the flexure strip has a raised middle portion.

In accordance with a further aspect of the present invention, the flexure strip has a plurality of catches integrally formed at two sides thereof to provide a secure effect.

In accordance with still a further aspect of the present invention, a base defining the recess of the body further has a protrusion extending upwardly from an appropriate position thereof and the flexure strip defines a hole therein to correspond to the protrusion.

Other objects, advantages and novel features of the invention will become more apparent from the following detailed description when taken in conjunction with the accompanying drawings.

DETAILED DESCRIPTION OF PREFERRED EMBODIMENT

Figure 1:
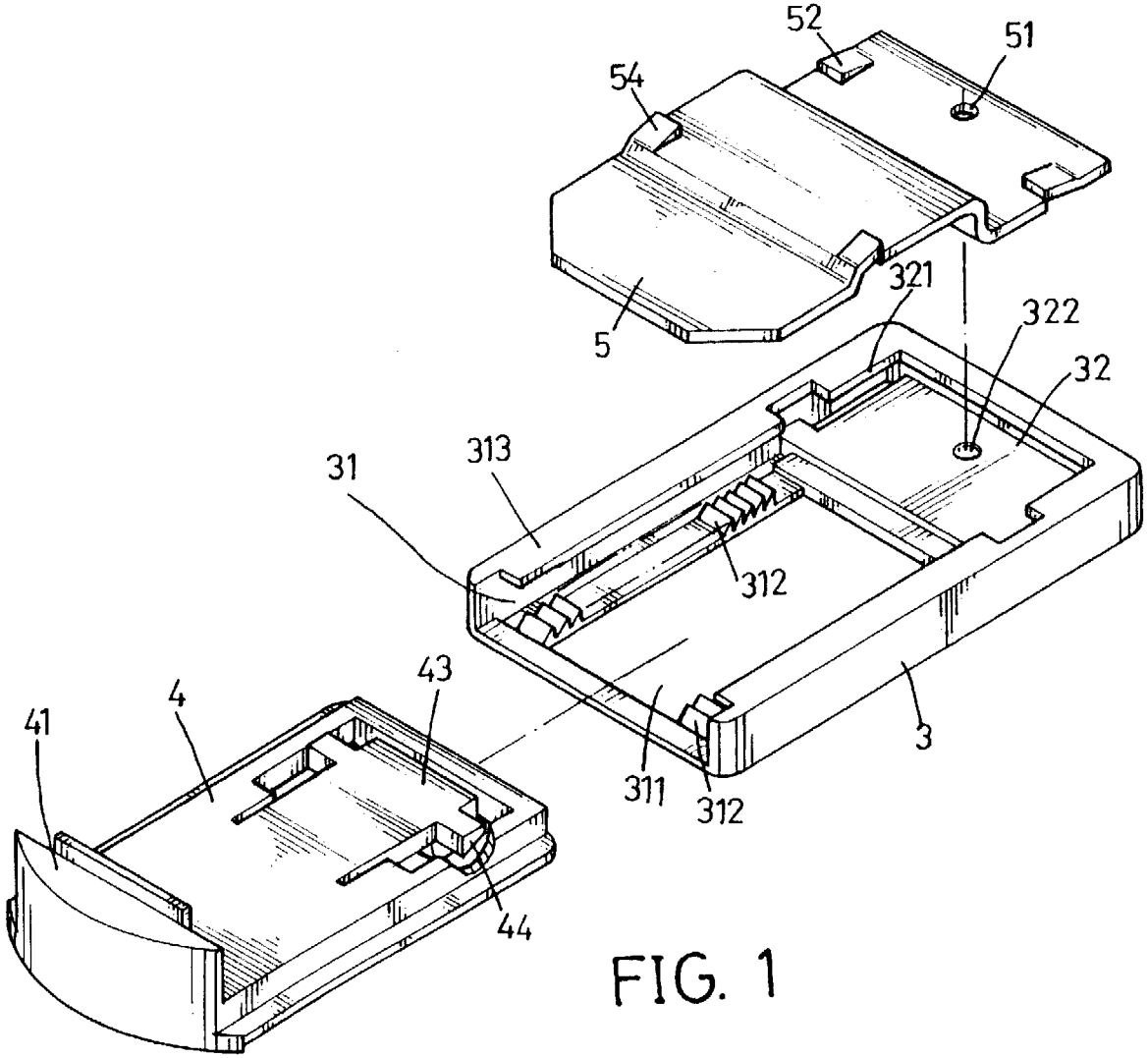
FIG. 1 is an exploded view showing the elements of a fastening for securing an apparatus to a belt in accordance with the present invention.
Figure 2:
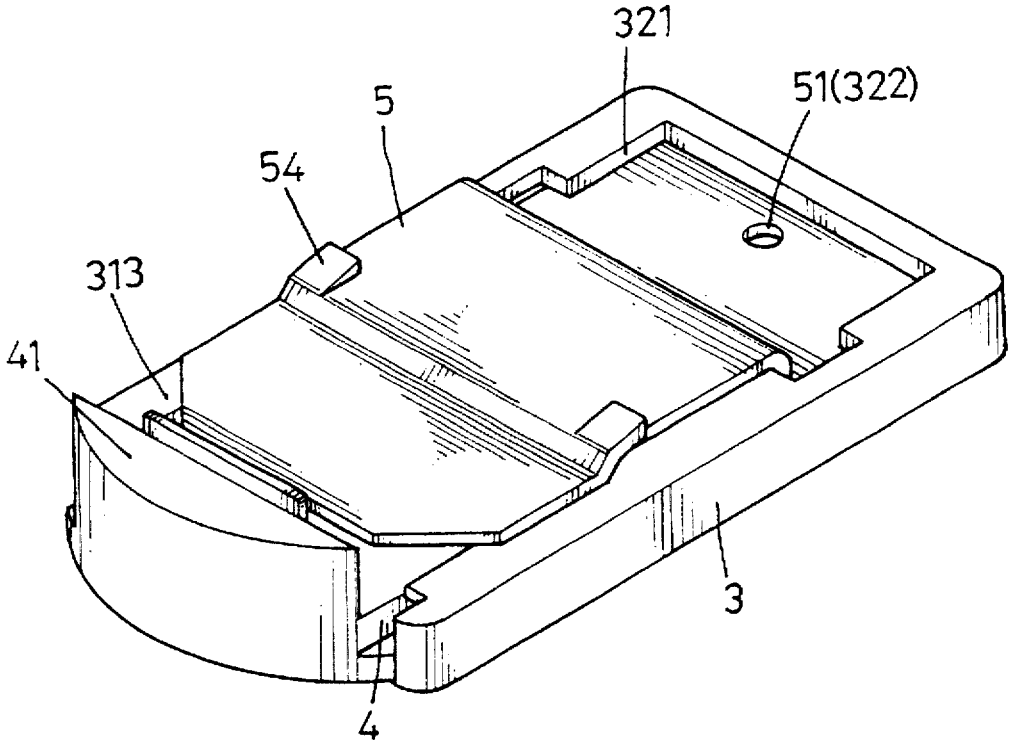
FIG. 2 is a perspective view showing a combined structure of the fastening for securing an apparatus to a belt of FIG. 1.

Referring to FIG. 1, a fastening for securing an apparatus to a belt in accordance with the present invention comprises a rectangular body 3, a board 4, and a flexure strip 5.

The body 3 defines a recess 32 in a front portion thereof for receiving the flexure strip 5. The recess 32 is partly defined by a pair of flanges 321 respectively extending from two opposed sides of a top periphery thereof to locate the flexure strip 5. A protrusion 322 integrally extends upward from a base partly defining the recess 32. The body 3 further defines a pair of channels 31 at opposed two side walls of a rear portion thereof so that the board 4 can be slidably received in the channels 31 to engage with the body 3. The rear portion of the body 3 further defines an aperture 311 therein and has a plurality of ratchet teeth 312 uniformly distributed at two opposed long sides of a periphery defining the aperture 311.

Figure 4:
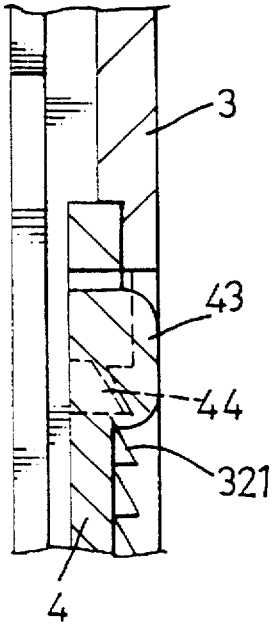
FIG. 4 is an enlarged schematic view of FIG. 3, showing the engagement of pawls and ratchet teeth of the fastening for securing an apparatus to a belt in accordance with the present invention.
Figure 6:
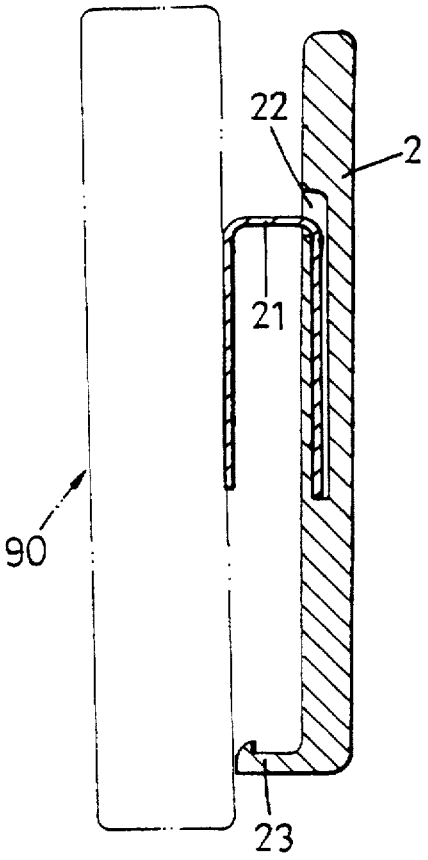
FIG. 6 PRIOR ART
FIG. 6 is a side cross-sectional view showing another conventional fastening for securing an apparatus to a belt.
Figure 5:
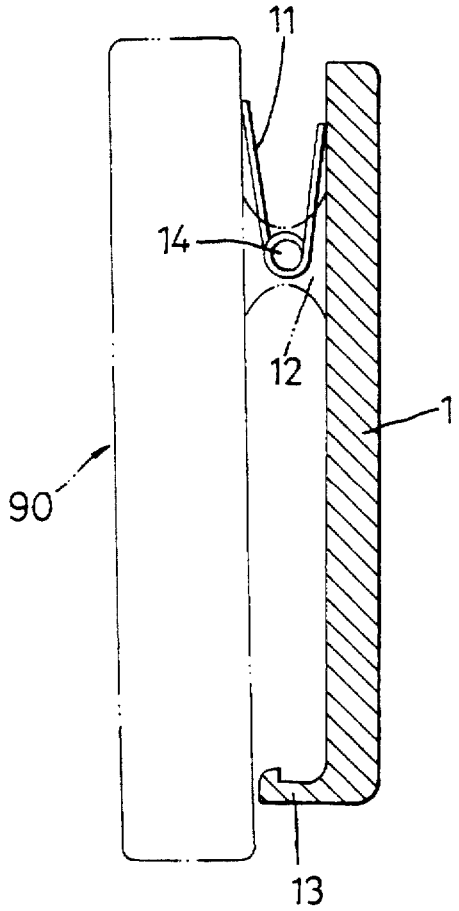
FIG. 5 PRIOR ART
FIG. 5 is a side cross sectional view showing a conventional fastening for securing an apparatus to a belt.
Figure 8:
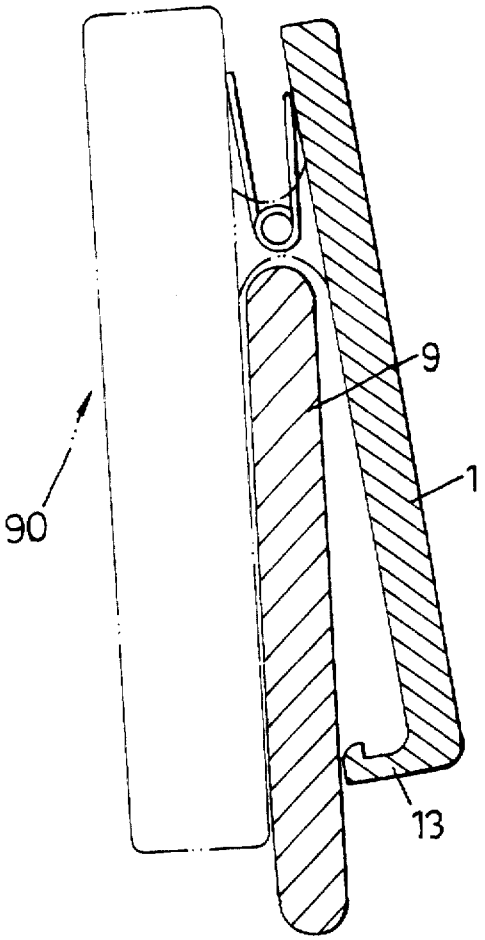
FIG. 8 PRIOR ART
FIG. 7 and FIG. 8 are side cross sectional views respectively showing the conventional fastening engaging with a narrow belt and a wide belt.
Figure 7:
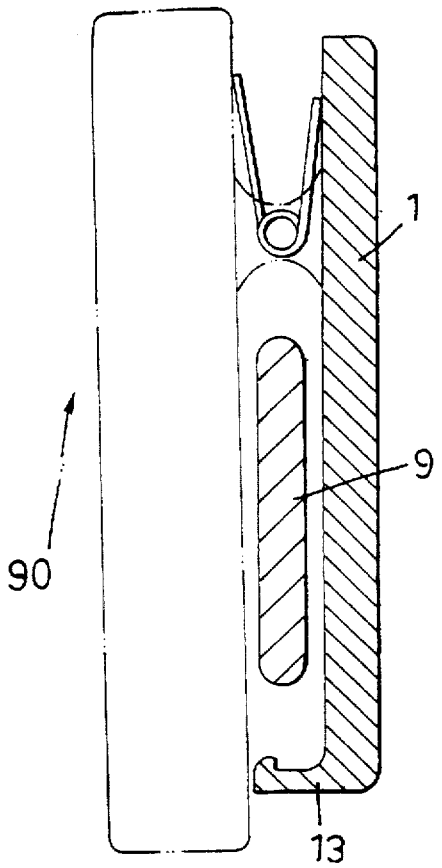
FIG. 7 PRIOR ART

As above mentioned, the board 4 is slidably received in the pair of the channels 31 of the body 3. The board 4 has a pair of pawls 44 integrally formed at a front end thereof for engaging with a respective pair of the ratchet teeth 312 and are configured such that board 4 can only move toward the front portion of the body 3, when the pawls 44 are in a non-depressed status as shown in FIG. 4. In addition, a press bar 43 is integrally formed between the pawls 44. The press bar 43 can extend beyond the aperture 311 of the body 3 when it is pressed. The board 4 further has a hook 41 integrally formed at a rear end thereof for abutting a lower edge of a belt of a user.

Figure 3:
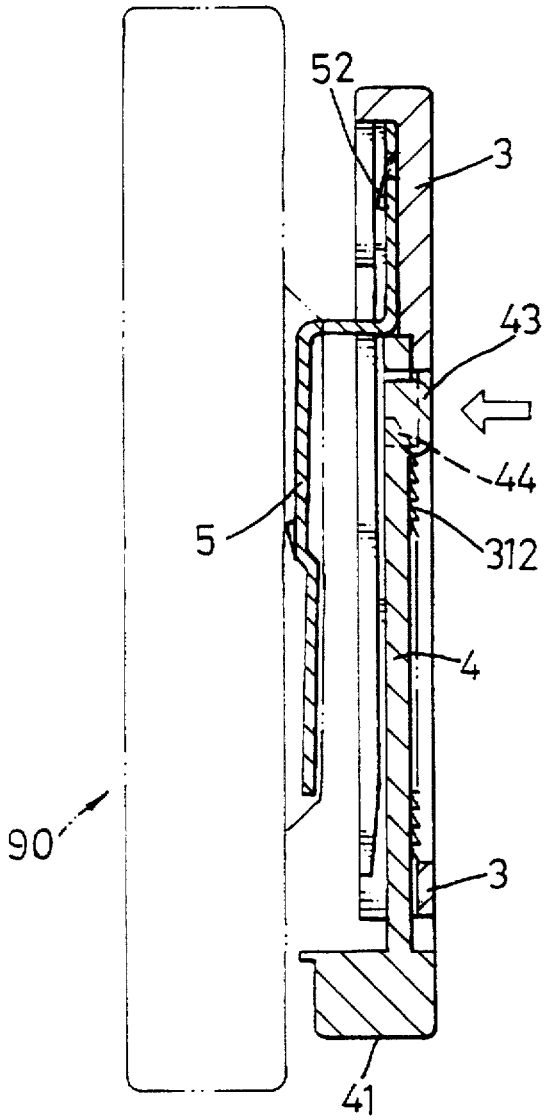
FIG. 3 is a side view partly in cross-sectional view of the fastening for securing an apparatus to a belt of FIG. 1.

The flexure strip 5 integrally forms a front portion, a raised middle portion and a rear portion (all not numbered). The front portion has a first pair of catches 52 integrally formed on two opposed sides thereof so that the catches 52 are retained by the flanges 321 of the body 3 when the front portion is received within the recess 32 of the body 3, thereby providing a securing effect, as shown in FIG. 3. The front portion further defines a hole 51 therein to correspond to the protrusion 322 of the recess 32 so that the front portion of the flexure strip 5 can be engaged with the body 3 via the insertion of the protrusion 322 into the hole 51. A second pair of catches 54 is integrally formed on two opposing sides of the flexure strip 5 at a junction between the raised middle portion and the rear portion in order to provide a securing effect as shown in FIG. 3, when the raised middle portion and the rear portion is engaged with the apparatus 90, such as a pager, a mobile telephone, etc.

Referring to FIG. 3, in assembly, the middle portion and the rear portion of the flexure strip 5 are priorly mounted to a back of the apparatus 90 and the front portion of the flexure strip 5 is priorly received within the recess 32 of the body 3. Then the board 4 is inserted into the body 3 via the channels 31, which enables the pawls 44 to engage with the ratchet teeth 312. In this way, a space (not numbered) is defined between the board 4 and the back of the apparatus 90 for receiving the belt. Since the board 4 is slidably received within the body 3, the space can be adjusted to be adapted to different belts with various widths. Also, the board 4 can only move toward the front portion of the body 4 (upward in FIG. 3) to make the hook 41 abut the belt.

When the apparatus 90 is to be separated from the belt, the user may press the press bar 43 of the board 4 to separate the pawls 44 from the ratchet teeth 312. Therefore, the board 4 can be smoothly pulled out from the body 3, and the flexure strip 5 can be separated from the back of the apparatus 90.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fastening for securing an apparatus to a belt comprising:

a flexure strip adapted to be attached to the apparatus;

a body defining a recess in a front portion thereof for receiving said flexure strip, a pair of channels at two opposed sides of a rear portion thereof, and an aperture in the rear portion, said body further having a plurality of ratchet teeth uniformly distributed at two opposed sides of the aperture; and a board movably received in the pair of channels of the body, said board having pawls integrally formed at a front end thereof for engaging with a respective pair of the ratchet teeth, a press bar integrally formed between the pawls and a hook integrally formed at a rear end thereof for abutting a lower edge of the belt.

2. A fastening for securing an apparatus to a belt as claimed in claim 1, wherein said flexure strip has a raised middle portion.

3. A fastening for securing an apparatus to a belt as claimed in claim 1, wherein said flexure strip has a plurality of catches integrally formed at two opposed sides thereof.

4. A fastening for securing an apparatus to a belt as claimed in claim 1, wherein said recess of the body has a pair of flanges integrally extending from two opposed sides of a top periphery defining the recess.

5. A fastening for securing an apparatus to a belt as claimed in claim 1, wherein said recess of the body further has a protrusion extending upwardly from an appropriate position thereof and the flexure strip defines a hole therein to correspond to the protrusion of the recess.

* * * * *